United States Patent [19]

Widrig

[11] Patent Number: 4,974,763

[45] Date of Patent: Dec. 4, 1990

[54] GOLF BALL CLEANING ORGANIZATION

[76] Inventor: Craig J. Widrig, 105 Continental Dr., Lockport, N.Y. 14094

[21] Appl. No.: 439,158

[22] Filed: Nov. 20, 1989

[51] Int. Cl.[5] ..... A63B 47/04

[52] U.S. Cl. ..... 224/252; 224/148; 224/269; 224/904; 15/21 A; 15/105; 273/32 B

[58] Field of Search ..... 224/148, 274, 224–228, 224/252, 253, 269, 904, 918, 919; 15/105, 114, 209 R, 210 R, 104.92, 21 A; 273/32 B

[56] References Cited

U.S. PATENT DOCUMENTS

| | | | |
|---|---|---|---|
| 1,702,172 | 2/1929 | Rennie | 15/21 A |
| 1,710,816 | 4/1929 | Evans | 15/104.92 |
| 2,315,095 | 3/1943 | Rhodes | 224/228 |
| 2,687,835 | 8/1954 | Plonczak | 224/253 X |
| 3,350,736 | 11/1967 | Frazelle et al. | 15/209 R |
| 3,378,873 | 4/1968 | Strout | 15/210 R |
| 3,453,675 | 7/1969 | Barton et al. | 15/104.92 |
| 3,678,526 | 7/1972 | Burkholder | 15/21 A |
| 4,350,274 | 9/1982 | Morgan | 224/148 X |
| 4,350,457 | 9/1982 | Carnahan | 15/104.92 X |
| 4,464,072 | 8/1984 | Norwell | 401/137 |
| 4,701,968 | 10/1987 | Stoltzman | 15/21 A |
| 4,736,877 | 4/1988 | Clark | 224/252 |
| 4,750,232 | 6/1988 | Doney | 15/104.92 |
| 4,867,360 | 9/1989 | Howard | 224/148 X |
| 4,912,800 | 4/1990 | Zeltner | 15/114 |

FOREIGN PATENT DOCUMENTS

| | | | |
|---|---|---|---|
| 8605082 | 9/1986 | PCT Int'l Appl. | 15/209 R |
| 0008536 | of 1905 | United Kingdom | 15/21 A |
| 0012853 | of 1908 | United Kingdom | 15/21 A |
| 0354464 | 8/1931 | United Kingdom | 224/226 |

*Primary Examiner*—Henry J. Recla
*Assistant Examiner*—Casey Jacyna
*Attorney, Agent, or Firm*—Leon Gilden

[57] ABSTRACT

An apparatus is set forth wherein a cleaning fabric includes a flexible fabric sheet including an abrasive face and a soft cleansing face for the polishing and cleansing of associated golf balls. The cleansing fabric includes modifications that provides for a peel-away package insert of a cleansing solution, such as alcohol, to enhance a cleansing operation when opening of the packet is directed onto a cleansing surface of the fabric. The fabric further includes a further modification that includes a brush end and an abrasive cleansing end comprising a steel-wool type cleaner surface. The further modified fabric includes a transverse pocket positioned between laminated sheets for reception of a cleansing solution packet therewithin. The cleansing fabric is contained within a pouch, including a securement lid to be secured and worn to an individual's belt. A modified pouch includes a dispensing cavity for the fabric sheets and a second disposal cavity for containing the sheets subsequent to their use. A further modified container includes a cleansing powder contained within a first compartment, a water solution within a second compartment, and the cleansing fabric contained within a forwardly positioned storage pouch within the pouch of the instant invention.

2 Claims, 5 Drawing Sheets

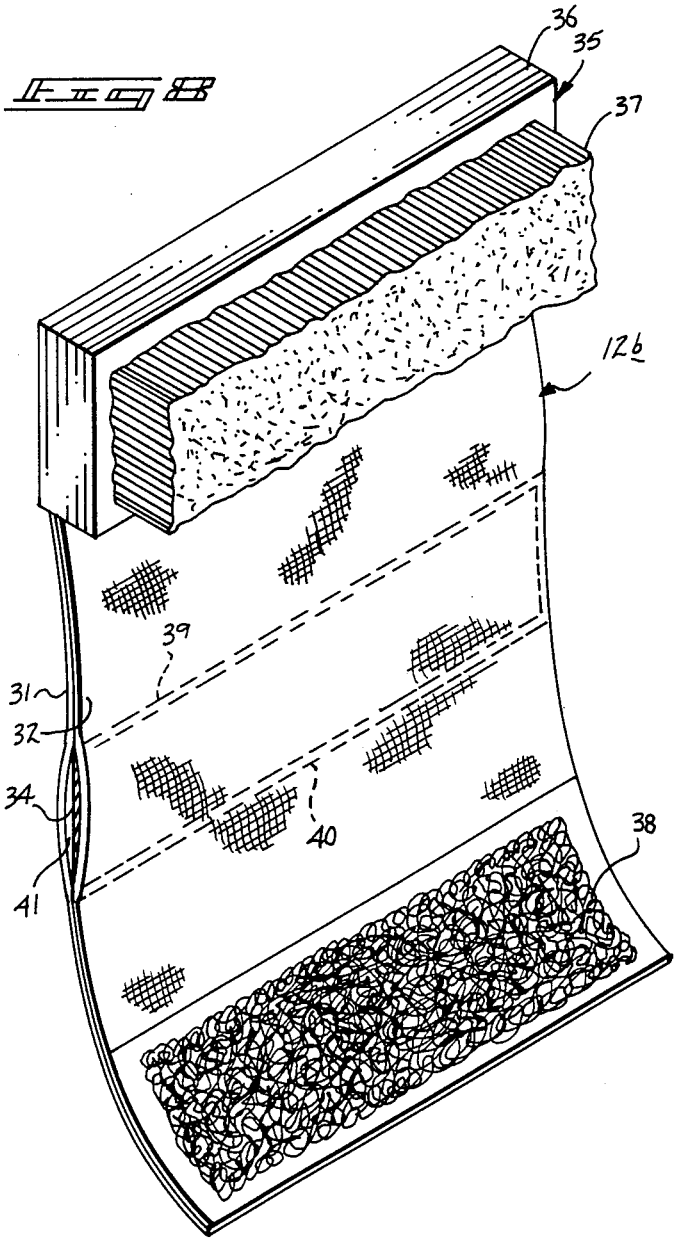
36
35
37
12b
39
31
32
34
41
40
38

GOLF BALL CLEANING ORGANIZATION

BACKGROUND OF THE INVENTION

1. Field of the Invention

The field of invention relates to golf ball cleaners, and more particularly pertains to a new and improved golf ball cleaning organization wherein the same is arranged for transport and securement to an individual's belt for cleansing of golf balls during a game playing procedure.

2. Description of the Prior Art

The use of golf ball cleaning apparatus is well known in the prior art. The prior art has utilized golf ball cleaning apparatus to clean golf balls to ensure their trajectory and trueness of flight in a golf game. Further in contemporary golf courses, the courses contain a great degree of chemicals, such as fertilizers and the like, with adverse allergic type reactions to many individuals sensitive to such chemicals. The need for an effective cleaning organization is desirable and necessary in the contemporary playing of golf games. To this end, the prior art has addressed the problem to provide golf cleaning organizations. For example, U.S. Pat. No. 1,710,816 to Evans sets forth a semi-spherical shell provided with a sponge interior surface to direct a cleaning liquid, such as water, to a golf ball inserted within the semi-spherical shell.

U.S. Pat. No. 4,350,457 to Carnahan sets forth a golf ball washing organization wherein a container includes a cleaning bowl therewithin of a semi-spherical configuration with a tube to direct a cleansing solution to the golf ball upon insertion within the apparatus.

U.S. Pat. No. 4,464,072 to Norwell sets forth a cleaning device including an attached brush member and a spray bottle secured to a clip for support by a belt or the like of an individual golfer.

U.S. Pat. No. 4,701,968 to Stoltzman sets forth a portable golf washing arrangement wherein a housing includes an elongate bulk cleansing chamber with an opening for receiving and securing the golf ball therewithin and a spray head for directing a cleansing fluid to the golf ball.

U.S. Pat. No. 4,736,877 to Clark sets forth a golf ball accessory holder for magnetic support of various items and accessories for use in the game of golf.

As such, it may be appreciated that there is a continuing need for a new and improved golf ball cleaning organization wherein the same addresses both the problems of effectiveness in the cleansing of golf balls and a means and manner for the containment and disposal of cleansing fabric utilized in the playing of the game of golf.

SUMMARY OF THE INVENTION

In view of the foregoing disadvantages inherent in the known types of golf ball cleaning apparatus now present in the prior art, the present invention provides a golf ball cleaning organization wherein the same is transportable and securable to an individual for providing a cleansing fabric for the effective and thorough cleaning of a golf ball. As such, the general purpose of the present invention, which will be described subsequently in greater detail, is to provide a new and improved golf ball cleaning organization which has all the advantages of the prior art golf ball cleaning apparatus and none of the disadvantages.

To attain this, the present invention includes an apparatus wherein a cleaning fabric includes a flexible fabric sheet including an abrasive face and a soft cleansing face for the polishing and cleansing of associated golf balls. The cleansing fabric includes modifications that provides for a peel-away package insert of a cleansing solution, such as alcohol, to enhance a cleansing operation when opening of the packet is directed onto a cleansing surface of the fabric. The fabric further includes a further modification that includes a brush end and an abrasive cleansing end comprising a steel-wool type cleaner surface. The further modified fabric includes a transverse pocket positioned between laminated sheets for reception of a cleansing solution packet therewithin. The cleansing fabric is contained within a pouch, including a securement lid to be secured and worn to an individual's belt. A modified pouch includes a dispensing cavity for the fabric sheets and a second disposal cavity for containing the sheets subsequent to their use. A further modified container includes a cleansing powder contained within a first compartment, a water solution within a second compartment, and the cleansing fabric contained with a forwardly positioned storage pouch within the pouch of the instant invention.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf ball cleaning organization which has all the advantages of the prior art golf ball cleaning apparatus and none of the disadvantages.

It is another object of the present invention to provide a new and improved golf ball cleaning organization which may be easily and efficiently manufactured and marketed.

It is a further object of the present invention to provide a new and improved golf ball cleaning organization which is of a durable and reliable construction.

An even further object of the present invention is to provide a new and improved golf ball cleaning organization which is susceptible of a low cost of manufacture with regard to both materials and labor, and which accordingly is then susceptible of low prices of sale to the consuming public, thereby making such golf ball cleaning organizations economically available to the buying public.

Still yet another object of the present invention is to provide a new and improved golf ball cleaning organization which provides in the apparatuses and methods of the prior art some of the advantages thereof, while simultaneously overcoming some of the disadvantages normally associated therewith.

Still another object of the present invention is to provide a new and improved golf ball cleaning organization wherein the same provides a flexible cleansing fabric of various cleansing surfaces and of optional accessories secured thereto for the cleansing of a golf ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a further modified cleansing fabric utilized by the instant invention.

DESCRIPTION OF THE PREFERRED EMBODIMENT

Figure 1:
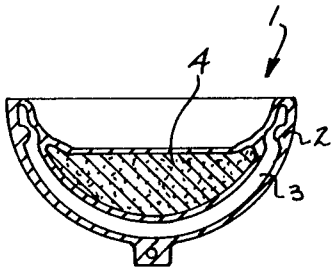
FIG. 1 PRIOR ART
FIG. 1 is a cross-sectional view of a prior art golf ball cleaning apparatus.

With reference now to the drawings, and in particular to FIGS. 1 to 8 thereof, a new and improved golf ball cleaning organization embodying the principles and concepts of the present invention and generally designated by the reference numeral 10 will be described.

FIG. 1 is illustrative of a typical prior art device wherein a semi-cylindrical shell 2 provides a well 3 for communication with a captured sponge 4 wherein a golf ball may be positioned in communication with the sponge 4 that in turn extracts a cleansing fluid from the cavity or well 3 for communication with a golf ball positioned within the housing.

Figure 2:
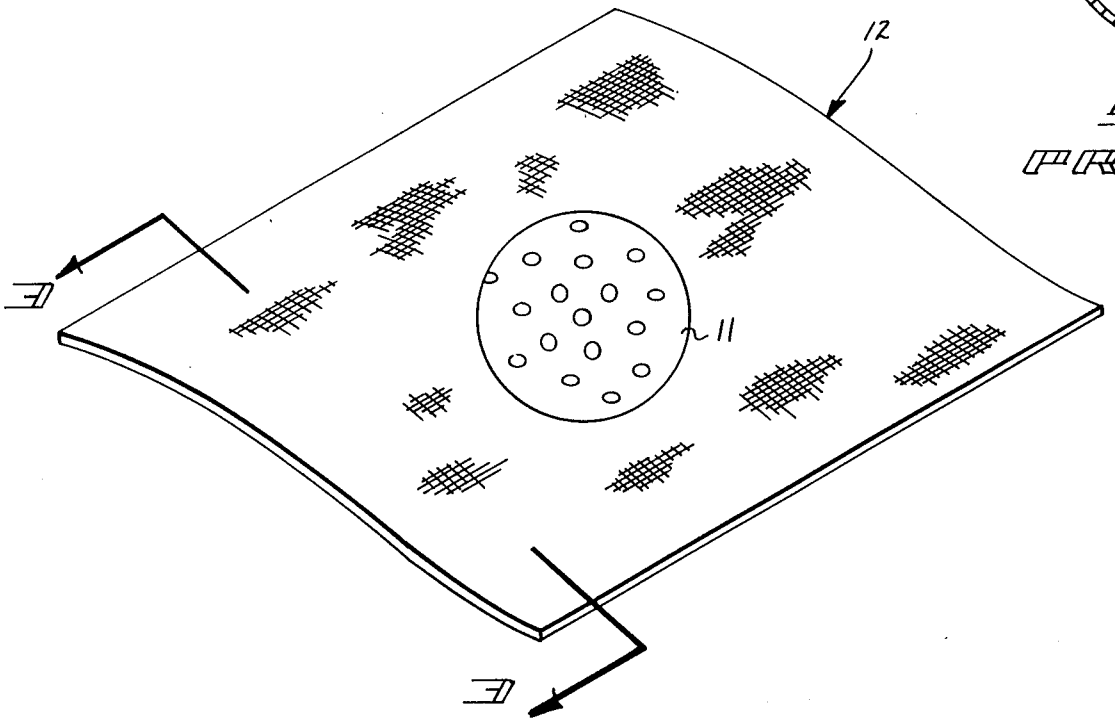
FIG. 2 is an isometric illustration of a cleansing fabric utilized by the instant invention.

FIG. 2 is illustrative of a cleaning fabric sheet 12 utilized by the instant invention wherein the flexible sheet is utilized to cleanse the exterior surface of a golf ball 11. The fabric sheet 12, as illustrated in FIG. 3, includes a plurality of laminated sheets coextensive with one another, wherein a first sheet defines a course, roughened surface 10*a* and a second sheet defines a smooth polishing surface 10*b* to effect a two cleansing of an associated golf ball to initially remove debris with subsequent smoothing of the surface of the golf ball to minimize alteration of the golf ball trajectory in use.

Figure 4:
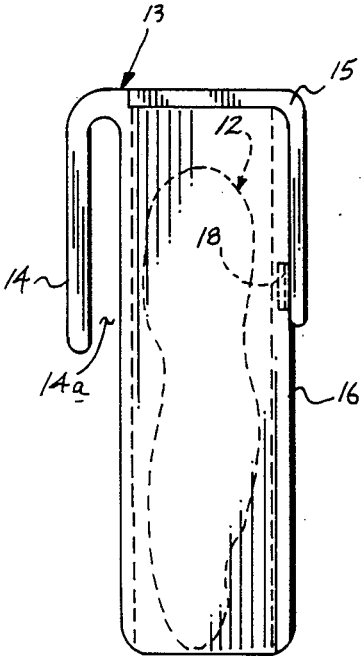
FIG. 4 is an orthographic side view taken in elevation of a pouch utilized by the instant invention.

FIG. 4 illustrates the invention 10 and the use of a first pouch 13 that defines a belt clip 14 extending from a rear surface thereof to define a belt recess 14*a* for enabling the pouch 13 to be positioned upon an associated belt of an individual. A covering flap lid 15 cooperates to overlie an opening of an underlying container 17 to receive an associated cleaning sheet 12. A hook and loop fastener arrangement 18 cooperating with a lowermost interior surface of the lid 15 and exterior forward surface of the container 16 enables securement of the lid 16 to overlie the container.

Figure 3:
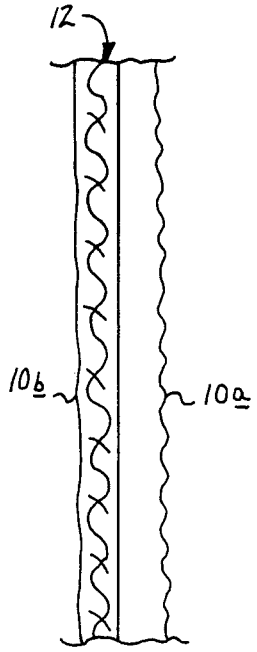
FIG. 3 is an orthographic cross-sectional view taken along the lines 3—3 of FIG. 2 in the direction indicated by the arrows.
Figures 5, 6:
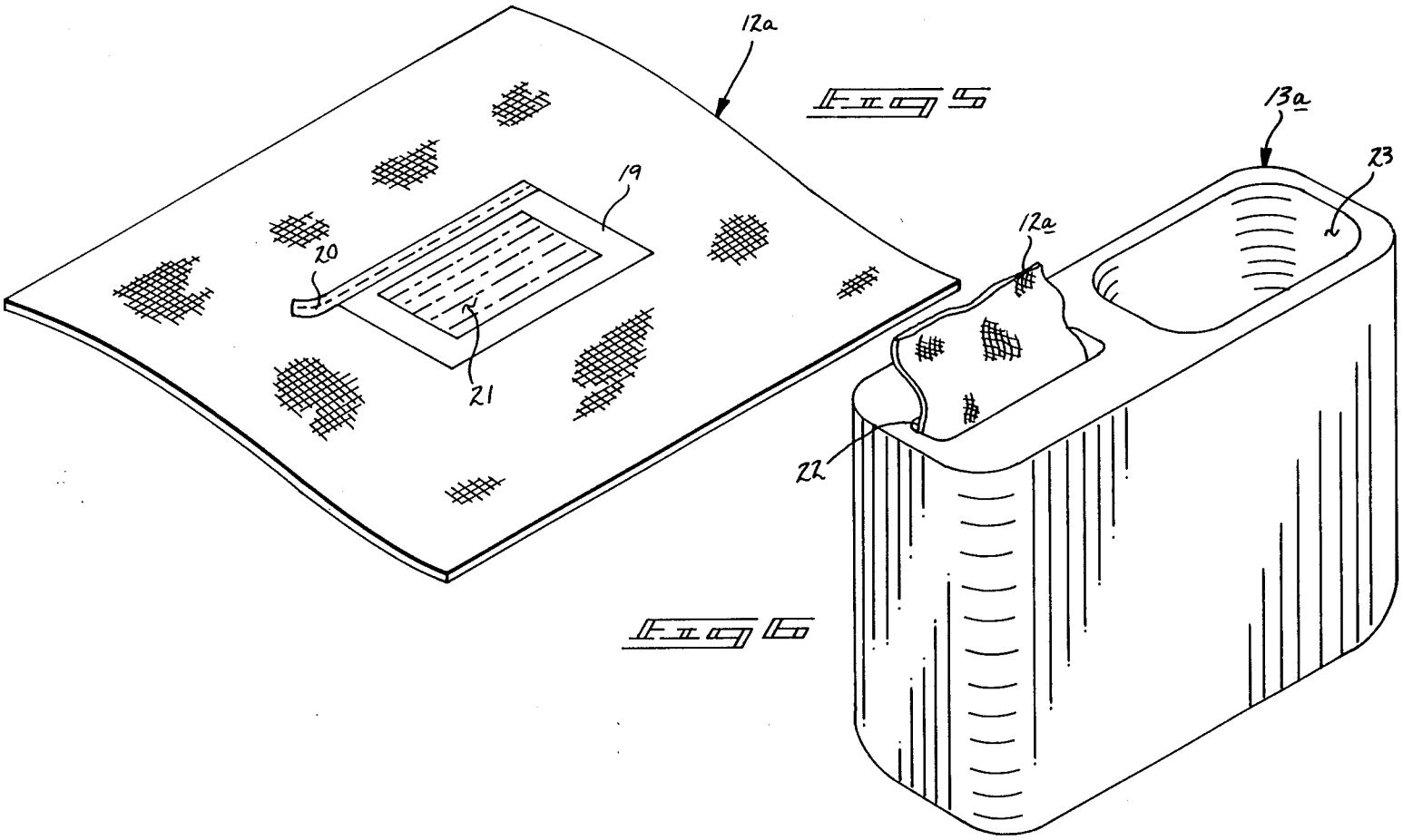
FIG. 5 is an isometric illustration of a modified cleansing fabric utilized by the instant invention
FIG. 6 is an isometric illustration of a modified pouch utilized by the instant invention.

FIG. 5 illustrates a modified cleaning fabric sheet 12*a* wherein the sheet includes the course, roughened surface and the smooth polishing surface 10*a* and 10*b* respectively of the sheet 12, as illustrated in FIG. 3, and further includes a transparent cover membrane 19 secured and adhesively mounted overlying either a surface 10*a* or 10*b*, with a tear strip 20 providing access to an interior cleansing solution 21 secured therewithin. The cleansing solution 21 may be of a water soluble solution or of a petroleum based solution to enhance cleansing of the golf ball in use, as the solution is then dispersed about a surface of the sheet 12*a* in use. The sheets 12 or 12*a* may then be removably mounted within a dispensing cavity 22 extending interiorly of an elongate, modified pouch 13*a*, with an adjacent disposal cavity 28 for storage of the cleansing sheets subsequent to use.

Figure 7:
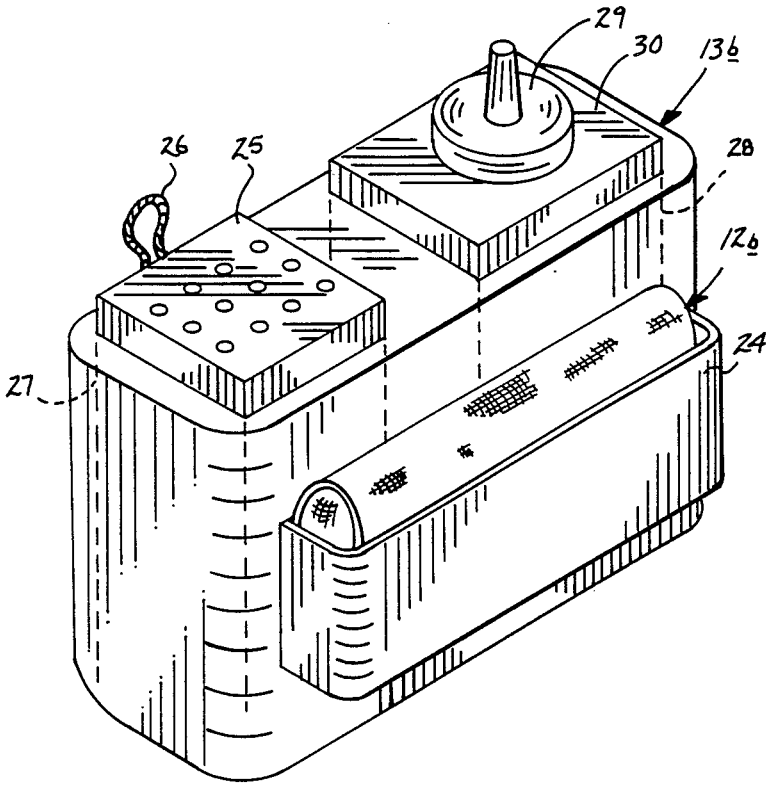
FIG. 7 is an isometric illustration of a further modified pouch utilized by the instant invention.

FIG. 7 illustrates a further modified pouch 13*b* wherein a storage pouch 24 defining an interior cavity mounted on a forward face of the further modified pouch 13*b* for receipt of a further modified cleansing fabric sheet 12*b* for reuse of the sheet 12*b* and storage thereof. The storage pouch 13*b* includes a first elongate compartment 27 adjacent a second elongate compartment 28, wherein the compartments 27 and 28 respectively receive a cleansing powder container 25 and a fluid dispensing container 30. The powder container 25 includes a securement loop 26 mounted thereto for enabling readily and accessible removal of the container 25, wherein the fluid dispensing container 80 includes a dispensing cap 29 removably mounted thereon that provides convenient manual grasping thereof for removal of the dispensing container 30.

The illustration per FIG. 8 illustrates the further modified flexible cleansing fabric sheet 12*b* that comprises a soft fabric sheet 31 co-laminated with an abrasive fabric sheet 32 of a roughened surface comparable to the construction of FIG. 3, but the co-laminated sheets 31 and 32 spaced first and second transverse seams 39 and 40 extensively formed transversely to the longitudinal length of the sheet 12*b* to define a transverse pocket 41 formed with an opening for selective removal of an alcohol packet 84 to enable the alcohol packet to be opened and the alcohol used as a cleansing medium for dispersion about a surface of the sheet 31 or 32 in use. The abrasive sheet 32 includes a brush member 35 mounted adjacent one end thereof coextensive with an upper end and an abrasive pad 38 utilizing steel or fabric wool for enhanced cleansing capability for use with a golf ball at the opposed end of the abrasive sheet 32.

The brush member 35 includes a rigid support base 36 mounting a matrix of bristles 37 thereon.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf ball cleaning organization comprising, in combination, a pouch number including a container member formed with a belt receiving clip integrally mounted to a rear face of the container member to define a belt recess therebetween the clip member and the rear face of the container member, and a cavity means defined within the member for storage of a flexible cleansing fabric sheet, and wherein the container member includes a first cavity spaced from a second cavity within the container member, the first cavity containing a cleansing powder container, and the second compartment containing a fluid dispensing container therewithin, the cleansing powder container including a securement loop fixedly mounted thereto to enhance manual grasping and removal of the cleansing powder container from the first compartment, and further including a storage pouch fixedly mounted to a forward face of the container member wherein the cavity means is defined by the first compartment, second compartment, and storage pouch, and the storage pouch selectively securing the cleansing fabric sheet therewithin.

2. A golf ball cleaning organization as set forth in claim 1 wherein the cleansing fabric sheet comprising a first abrasive sheet member coextensive with and laminated to a soft fabric sheet, and further including a first transverse seam spaced from a second transverse seam orthogonally formed medially of the flexible cleansing fabric sheet, wherein the soft fabric sheet and the abrasive fabric sheet define a space therebetween to define the transverse pocket, and a cleansing packet positionable within the transverse pocket, and a brush member mounted on a first end of the abrasive fabric sheet, wherein the brush member includes a rigid support and a bristle matrix mounted on the rigid support, and an abrasive pad mounted on a second end of the abrasive fabric sheet spaced from the brush member, wherein the abrasive pad includes a matrix of cleansing fibers formed to the abrasive pad.

* * * * *